US005394895A

United States Patent [19]

Muramatsu et al.

[11] Patent Number: 5,394,895

[45] Date of Patent: Mar. 7, 1995

[54] TIPPING PAPER AND CIGARETTE USING THE SAME

[75] Inventors: Motohiko Muramatsu; Kazuko Takeda; Yasuyuki Futamura; Takayoshi Sagawa, all of Yokohama, Japan

[73] Assignee: Japan Tobacco, Inc., Tokyo, Japan

[21] Appl. No.: 283,744

[22] PCT Filed: Mar. 9, 1992

[86] PCT No.: PCT/JP92/00280

§ 371 Date: Nov. 9, 1992

§ 102(e) Date: Nov. 9, 1992

[87] PCT Pub. No.: WO92/15209

PCT Pub. Date: Sep. 17, 1992

Related U.S. Application Data

[63] Continuation of Ser. No. 946,342, Nov. 9, 1992, abandoned.

[30] Foreign Application Priority Data

Mar. 11, 1991 [JP] Japan ..... 3-045142
Mar. 11, 1991 [JP] Japan ..... 3-045143

[51] Int. Cl.[6] ..... A24D 1/04
[52] U.S. Cl. ..... 131/365; 131/336
[58] Field of Search ..... 131/365, 336

[56] References Cited

U.S. PATENT DOCUMENTS 3,228,402 1/1966 Lebert ..... 131/336 X
3,572,347 3/1971 Sherrill ..... 131/10.5
4,295,487 10/1981 Purton ..... 137/242
4,303,080 12/1981 Boegli et al. ..... 131/202
4,362,172 12/1982 Johnson ..... 131/336
4,481,960 11/1984 Brooks ..... 131/336
4,582,071 4/1986 Westcott et al. ..... 131/336

FOREIGN PATENT DOCUMENTS 54-62400 5/1979 Japan .
58-60983 4/1983 Japan .
864247 3/1961 United Kingdom .
2095532 10/1982 United Kingdom .
2090117 12/1991 United Kingdom .

OTHER PUBLICATIONS

*Recent Advantages in Tobacco Science,* Developing Quality Attributes in Smoking Products, vol. 13, 41st Tobacco Chemists' Research Conference, Oct. 4–7, 1987.

*Beitrage Zur Tabakforschung International,* vol. 9, No. 4, Jul. 1978.

W. A. Selke, *Permeable Papers for Cigarette Construction,* TR, Sep. 1978, pp. 40–43.

*Recent Advances in Tobacco Science,* Design of Low Tar Cigarettes, vol. 10, 38th Tobacco Chemists' Research Conference, Nov. 5–8, 1984.

*Recent Advances in Tobacco Science,* Chemical Physical and Production Aspects of Tobacco and Smoke, vol. 6, 34th Tobacco Chemists' Research Conference, Oct. 27–29, 1980.

*Primary Examiner*—William H. Grieb

[57] ABSTRACT

The vented filter cigarette is produced by combining a filter having a highly air-permeable circumferential surface and a tipping paper having a plurality of pores. The tipping paper has an embossment in the area of the pores formed therein. The embossment serves to create a slight gap between the tipping paper and the circumferential surface of the filter, by which the tightness therebetween is loosened. Thus, the filter ventilation is increased, and the variation in the degree of the ventilation can be reduced.

7 Claims, 2 Drawing Sheets

TIPPING PAPER AND CIGARETTE USING THE SAME

This application is a continuation of U.S. patent application Ser. No. 07/946,342, filed Nov. 9, 1992, now abandoned.

FIELD OF THE INVENTION

The present invention relates to a tipping paper used for a cigarette, with which the variation in the amount of air flow from the vented filter (filter ventilation) can be reduced, and to a cigarette using such a tipping paper.

DESCRIPTION OF THE PRIOR ART

A conventional cigarette filter is made of a fiber filter material such as cellulose diacetate wrapped by a plug wrap paper to form a cylindrical shape. A tipping paper is used for connecting the filter rod and a tobacco rod. Recently, vented filters each made by combining an air-permeable plug wrap paper and a tipping paper having pores or perforations formed by means of static electricity, laser, etc. with each other, are widely used to reduce the yield of smoke effusing through the filter rod by allowing air to enter through the periphery of the filter. With the vented filter having the above-described structure, dilution air drawn into the filter is inhaled into the smoker's mouth from the outer portion of the mouth end face of the filter, whereas tobacco smoke is inhaled into the mouth from the center portion of the mouth end face.

However, the conventional vented filter cigarette generally entails the problem of a large variation in filter ventilation even though the filter material, plug wrap paper, and tipping paper of the cigarette are the same, respectively. Since the filter ventilation and the amount of smoke inhaled are strongly correlated, the variation of the filter ventilation should be suppressed as much as possible.

The present invention has been proposed to solve the above-described problem, and the purpose thereof is to provide a cigarette which can surely control its filter ventilation.

SUMMARY OF THE INVENTION

In order to achieve the above-mentioned purpose, the authors of the present invention researched intensively about the variation in filter ventilation of the vented filter cigarettes. The inventors conducted a variety of tests on the filter ventilation, the following results were obtained. The degree of the variation is correlated to the tightness between the plug wrap paper (or the circumference surface of the filter, in the case where no plug wrap paper is used) and the tipping paper, rather than the variation in permeability of the materials. Depending on the degree of the tightness, the ventilation area of the plug wrap paper through which the dilution air passes differs from one product to another. As a result, the filter ventilation cannot be uniformly controlled even if the same material is used.

In consideration of the above results of the research, the inventors further carried out a number of tests, and discovered that the filter ventilation can be increased, and the variation therein can be reduced by separating vent zone of the tipping paper from the plug wrap paper of the filter by means of an embossment formed around the vent zone of the tipping paper.

According to the first aspect of the invention, there is provided a tipping paper to be used in combination with a filter having a highly permeable circumferential surface to produce a vented filter cigarette, the tipping paper includes a plurality of pores or perforations, and an embossment formed in the region including the vent zone.

Further, according to the second aspect of the invention, there is provided a vented filter cigarette produced by combining a filter having a highly permeable circumferential surface and a tipping paper having a plurality of pores or perforations, the vented filter cigarette having an embossment on the tipping paper in the region including the vent zone.

The present invention is characterized by the above-described structure in which the embossment provides a slight gap between the tipping paper and the circumferential surface of the filter around the area including the vent zone. With this gap, the tightness between the tipping paper and the circumferential surface of the filter is loosened, thereby increasing ventilation of air from the vented portion of the filter, and decreasing the variation in the filter ventilation.

DETAILED DESCRIPTION OF THE PREFERRED EMBODIMENT

Figure 1:
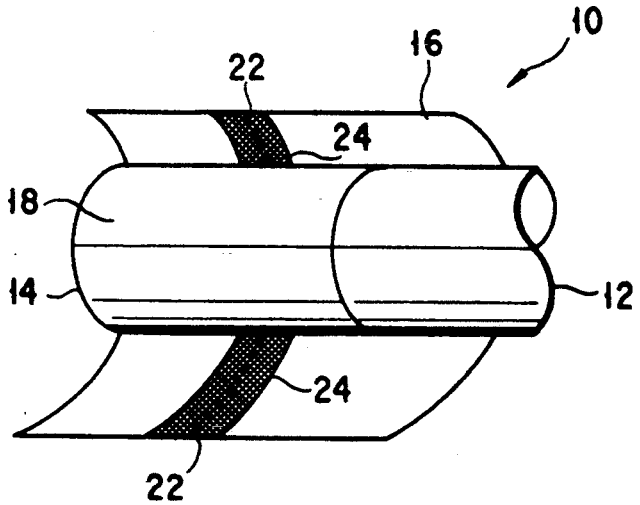
FIG. 1 is a schematic development view of a tipping paper and part of a cigarette according to an embodiment of the invention.

FIG. 1 is a schematic development view of a tipping paper and part of a cigarette according to an embodiment of the invention. As shown in this figure, a cigarette 10 comprises a tobacco rod 12 and a filter 14. The filter 14 is made of a fiber filter material such as cellulose diacetate wrapped by a plug wrap paper 18. Further, a tipping paper 16 is used to connect the filter 14 and the tobacco rod 12 with each other. The tipping paper 16 is secured to the plug wrap paper 18 and the tobacco rod 12 by the conventional use of glue. Such a conventional use of glue is illustrated in the publication RECENT ADVANCES IN TOBACCO SCIENCE, Vol. 13, page 85 which is hereby incorporated by reference for purposes of illustrating the state of the art.

The cigarette 10 is of a vented filter type, and employs a highly permeable plug wrap paper 18 having a Coresta permeability of 1000 or more, for the purpose of the reduction of the yield of smoke flowing out of the mouth end of the filter. Further, the tipping paper 16 of the cigarette has a number of ventilation pores or perforations 22 formed on the paper in one or plural rows along the circumferential direction. It should be noted that all the types of filter cigarette products do not always employ plug wrap papers. The pores or perforations 22 of the tipping paper 16 can be made by a known technique, for example, the electrostatic method, or the laser method. With the cigarette 10 of this type, dilution air is inhaled into the smoker's mouth from the outer portion of the mouth end face of the filter, and tobacco smoke from the center portion thereof.

A grid-patterned embossment 24 is provided on the tipping paper 16 along the row of the pores 22. More specifically, the embossment 24 is printed in the band-like region located such that the pores 22 are arranged in the imaginary center line of the region, by means of, for example, a knurling tool. Thus, the embossment 24 provides ruggedness in the entire area of the band-like region including the pores 22. This ruggedness apparently increases the thickness of the tipping paper in the area of the pores 22 by about 100–500 μm, which was measured by the Z-axis reading device of a 2.5 dimension CNC coordinate measurement apparatus, μ-STAFF (product of NIKON, trademark).

In the cigarette having the above-described structure according to the present invention, the embossment 24 serves to create a slight gap between the tipping paper 16 and the plug wrap paper 18, and loosens the tightness between the members 16 and 18, increasing the air permeability of the combination of the pores 22 and the plug wrap paper 18. Further, the embossment 24 also serves to reduce the variation in the air permeability. Consequently, the filter ventilation is increased, and the variation in the filter ventilation is also reduced.

The width of the embossment 24 should be at least 1 mm on each side of the pores 22 made in line. If the distance from the pore line to the end of the embossment is less than 1 mm, it is difficult to create a gap sufficiently between the pores 22 and the plug wrap paper 18 of the filter 14. Further, the glue which secures the tipping paper 16 to the plug wrap paper 18 is not provided in an annular region having a predetermined width which corresponds to or covers the pores 22. A ventilation area of the plug wrap paper 18 is formed in the annular region.

Figure 6:
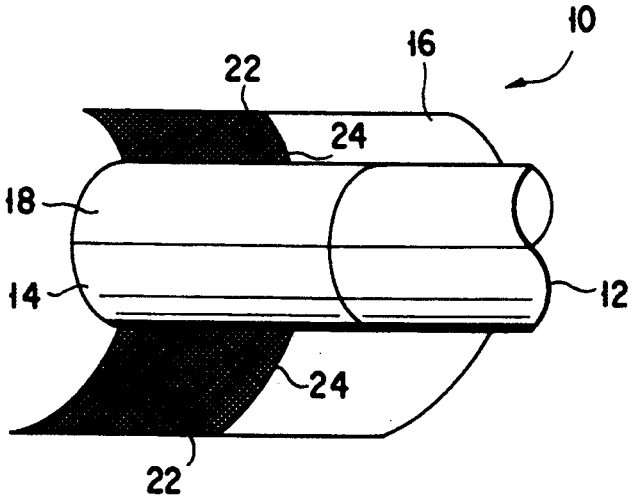
FIG. 6 is a schematic development view of a tipping paper and part of a cigarette according to another embodiment of the invention.

It is possible to form the embossment 24 in almost the entire surface of the tipping paper 16, or the embossment 24 can be formed only on the filter end side of the tipping paper up to the end, as can be seen in FIG. 6. The above-mentioned cases are advantageous since such tipping papers 16 rarely stick to the smoker's lips.

The height of the configuration of the pattern of the embossment 24 should preferably be in a range of 0.05–1.0 mm. If the height exceeds this upper limit, a problem in cigarette making can occur, whereas if the height is lower than this lower limit, the above-described effect of the embossment 24 cannot be obtained to a sufficient level.

It is preferable that the embossment 24 should be disposed such that the surface thereof brought into direct contact with the pattern press die faces inward. With structure in which the contact surface faces inward, the pores 22 can be separated sufficiently from the plug wrap paper 18. In the case of the contrary case, or, if the contact surface faces outward, the effect of the embossment is slightly lessened as compared to the former case.

Figure 2:
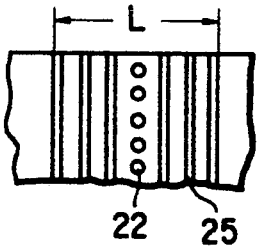
FIG. 2 is a schematic diagram showing part of a tipping paper according to the invention, having another pattern of embossment.
Figure 3:
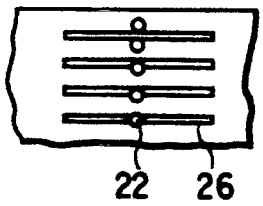
FIG. 3 is a schematic diagram showing part of a tipping paper according to the invention, having another pattern of embossment.
Figure 4:
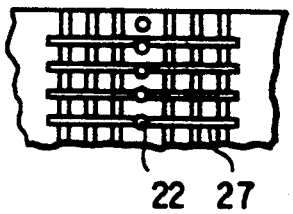
FIG. 4 is a schematic diagram showing part of a tipping paper according to the invention, having another pattern of embossment.
Figure 5:
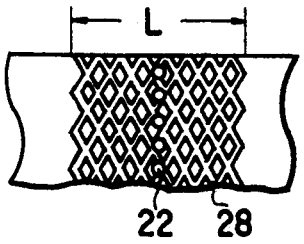
FIG. 5 is a schematic diagram showing an enlarged view of the embossment of the tipping paper shown in FIG. 1.

The pattern of the embossment 24 is not limited to the pattern of the rhombic grid-like grooves shown in FIG. 1, an enlarged portion of which shown in FIG. 5 as an embossment 28, but the embossment may be formed into a variety of patterns. Some of the basic examples are shown in FIGS. 2–4. FIG. 2 depicts an embossment 25 having a pattern in which grooves are arranged parallel with the line of the pores 22. FIG. 3 depicts an embossment 26 having a pattern in which grooves are arranged perpendicular to the line of the pores 22. FIG. 4 depicts an embossment 27 having a pattern of a square grid.

Using cigarettes employing these examples, the following experiments were conducted.

EXPERIMENT 1

By use of the tipping papers embossed in different patterns around the ventilating pores as described above, and the other regular members, cigarette samples B (having the pattern shown in FIG. 2, where L=6 mm), C (that of FIG. 3), and D (that of FIG. 4) were prepared. For the sake of comparison, a cigarette sample A having no embossment provided was also prepared. The conditions of each sample other than the pattern of embossment, for example, the material, the production method, etc., were common unless so specified in the table exhibiting the results of the test. Each cigarette had a length of 84 mm, a filter length of 25 mm, a circumference of 25 mm, and a draw resistance of the tobacco rod of 80 mm $H_2O$.

Ten samples were prepared for each type of cigarette, and mounted to a ventilation meter so as to measure the filter ventilation of each of the samples. The results were as shown in Table 1. In this table, the air permeability of the tipping paper and plug wrap paper is indicated by the Coresta unit. Further, reference symbol X is an average of the degree of filter ventilation (%), reference symbol $\sigma$ is a standard deviation thereof, and reference symbol CV is a variation coefficient expressed by the following equation.

$$CV=(\sigma/X)\times 100\ (\%)$$

TABLE 1

| Material/Permeability (Coresta) | | | | | |
|---|---|---|---|---|---|
| Tipping paper | | 300 | 300 | 600 | 600 |
| Plug wrap paper | | 2000 | 10000 | 2000 | 10000 |
| Sample/Filter ventilation | | | | | |
| A | X | 8.1 | 17.1 | 17.7 | 29.4 |
| | $\sigma$ | 2.7 | 2.5 | 5.4 | 3.3 |
| | CV | 33.3 | 14.7 | 30.5 | 11.6 |
| B | X | 15.9 | 24.3 | 25.6 | 37.7 |
| | $\sigma$ | 3.3 | 3.4 | 2.8 | 3.8 |
| | CV | 20.7 | 14.0 | 10.9 | 10.1 |
| C | X | 16.8 | 23.0 | — | — |
| | $\sigma$ | 3.9 | 2.1 | — | — |
| | CV | 23.1 | 9.3 | — | — |
| D | X | 22.4 | 30.0 | — | — |
| | $\sigma$ | 4.9 | 2.9 | — | — |
| | CV | 21.8 | 9.6 | — | — |

As can be seen in Table 1, it was confirmed by this experiment that the samples B, C, D each exhibited an increased filter ventilation, and a reduced variation therein, as compared to the sample A having no embossment formed.

EXPERIMENT 2

By use of the tipping papers having the embossment of the pattern shown in FIG. 5 formed around the ventilating pores, and the other regular members, cigarette samples F (where L=6 mm, the surface, which had been brought into contact with the pattern press die, facing inward), and G (where L=6, the surface, which had been brought into contact with the pattern press die, facing outward) were prepared. For the sake of comparison, a cigarette sample E having no embossment provided was also prepared. The conditions of each sample other than the pattern of embossment, for example, the material, the production method, etc., were common unless so specified in the table exhibiting the results of the test. Each cigarette had a length of 84 mm, a filter length of 25 mm, and a circumference of 25 mm. The material of the filter was acetate 2.2 Y/40.000, the tobacco rod used was a commercially available tobacco blend, and the width of the unglued zone between the tipping paper and the plug wrap paper was 9 mm.

100 samples were prepared for each type of cigarette, and mounted to a ventilation meter so as measure the filter ventilation of each of the samples. The results were as shown in Table 2. In this table, the air permeability of the tipping paper and plug wrap paper is indicated by the Coresta unit. Further, reference symbol X is an average of the degree of filter ventilation (%), reference symbol $\sigma$ is a standard deviation thereof, and reference symbol CV is a variation coefficient expressed by the following equation.

$$CV=(\sigma/X)\times 100\ (\%)$$

TABLE 2

| Material/Permeability (Coresta) | | | | | | | |
|---|---|---|---|---|---|---|---|
| Tipping paper | | 300 | 300 | 600 | 600 | 1200 | 1200 |
| Plug wrap paper | | 2000 | 10000 | 2000 | 10000 | 2000 | 10000 |
| Sample/Filter ventilation | | | | | | | |
| E | X | 22.1 | 28.3 | 35.1 | 45.1 | 40.9 | 57.50 |
| | $\sigma$ | 2.26 | 2.96 | 2.86 | 3.70 | 3.12 | 4.64 |
| | CV | 10.22 | 10.45 | 8.14 | 8.20 | 7.62 | 8.06 |
| F | X | 25.7 | 33.8 | 43.6 | 56.4 | 51.1 | 68.6 |
| | $\sigma$ | 2.54 | 2.68 | 2.48 | 2.90 | 2.98 | 3.36 |
| | CV | 9.88 | 7.92 | 5.69 | 5.14 | 5.83 | 4.89 |
| G | X | — | — | 40.5 | 51.40 | — | — |
| | $\sigma$ | — | — | 2.69 | 2.92 | — | — |
| | CV | — | — | 6.65 | 5.68 | — | — |

As can be seen in Table 2, it was confirmed by this experiment that the samples F and G each exhibit an increased filter ventilation, and a decreased variation therein, as compared to the sample E having no embossment formed. Further, the results indicate that the sample G exhibits a slightly less filter ventilation and a slightly more variation in filter ventilation than the sample F; therefore it was confirmed that the embossment exhibits a more enhanced effect in the case where the surface brought into contact with the pattern press die is used as the inner side of the tipping paper, than in the other case.

INDUSTRIAL APPLICABILITY

According to the present invention, an embossment is provided around the vent zone formed in the tipping paper. By use of the tipping paper having such a structure, not only the filter ventilation of a cigarette can be increased, but also the variation in the degree of the ventilation can be reduced. Consequently, the filter ventilation of the cigarette can be appropriately controlled, thereby providing a desired smoke yield of the cigarette.

Further, in the case where the embossment is formed in almost the entire surface of the tipping paper, the tipping paper does not stick to the smoker's lips easily, providing the smoker with comfortable smoking.

We claim:

1. A vented filter cigarette comprising:

a filter having a fiber filter material and a permeable plug wrap paper wrapping the fiber filter material, the plug wrap paper having a Coresta permeability of 1000 or more so as to have a high and substantially uniform permeability overall;

a tobacco rod; and tipping paper, having a plurality of pores, connecting the filter and the tobacco rod, the tipping paper being arranged not to reach an end of the tobacco rod which is to be lit;

wherein said permeable plug wrap paper has a ventilation area which faces said pores and through which dilution air from the pores passes, wherein an embossment is formed on the tipping paper in a region including said pores in order to loosen tightness between the tipping paper and the plug wrap paper in said ventilation area to control filter ventilation of the cigarette, and wherein said embossment is arranged only around the pores so as not to reach either end of the tipping paper.

2. The cigarette according to claim 1, wherein said embossment is formed in a region having a width of 1 mm or more on either side of the pores.

3. The cigarette according to claim 2, wherein said embossment has a depth ranging from 0.05 to 1.0 mm.

4. The cigarette according to claim 2, wherein said embossment is formed by a pattern press die, and a surface of said embossment having contacted the pattern press die faces said filter.

5. The cigarette according to claim 2, wherein said embossment has grooves of a grid-pattern.

6. The cigarette according to claim 2, wherein said pores constitute a row, and said embossment has grooves of a pattern parallel to the row of said pores.

7. The cigarette according to claim 2, wherein said pores constitute a row, and said embossment has grooves of a pattern perpendicular to the row of said pores.

* * * * *